United States Patent [19]

Grothe et al.

[11] Patent Number: 4,635,050

[45] Date of Patent: Jan. 6, 1987

[54] DYNAMIC STROKE PRIORITY GENERATOR FOR HYBRID DISPLAY

[75] Inventors: Steven P. Grothe, Glendale; Parm L. Narveson, Phoenix, both of Ariz.

[73] Assignee: Sperry Corporation, New York, N.Y.

[21] Appl. No.: 598,563

[22] Filed: Apr. 10, 1984

[51] Int. Cl.[4] ..... G09G 1/14

[52] U.S. Cl. ..... 340/734; 340/701; 340/721; 340/726; 340/739

[58] Field of Search ..... 340/721, 734, 736, 739, 340/745, 729, 701

[56] References Cited

U.S. PATENT DOCUMENTS

| | | | |
|---|---|---|---|
| 3,539,860 | 11/1970 | Max et al. | 340/729 |
| 4,200,866 | 4/1980 | Strathman | 340/739 |
| 4,412,296 | 10/1983 | Taylor | 340/729 |
| 4,490,797 | 12/1984 | Staggs et al. | 340/721 |
| 4,511,892 | 4/1985 | Grothe | 340/721 |

*Primary Examiner*—Gerald L. Brigance
*Assistant Examiner*—Jeffery A. Brien
*Attorney, Agent, or Firm*—Howard P. Terry; Arnold L. Albin

[57] ABSTRACT

A cathode ray tube provides a raster can symbol display superimposed on a stroke vector display, with selected regions of the stroke vector display preferentially masked in response to priority instructions. Stroke vector priority data is loaded into a full-field bit-mapped memory by a raster symbol generator and used to provide a stroke vector masking signal in synchronism with the picture elements of the raster scan. The system provides efficient generation of dynamic stroke priority areas by utilizing the repetitive nature of the raster scan to load the stroke priority full-field bit-mapped memory without requiring corresponding processor intervention.

12 Claims, 5 Drawing Figures

TYPICAL INTEGRATED FLIGHT INSTRUMENT DISPLAY FORMAT

TIMING DIAGRAM

DYNAMIC STROKE PRIORITY GENERATOR FOR HYBRID DISPLAY

BACKGROUND OF THE INVENTION

1. Field of the Invention

The invention relates to synthetically generated displays for aircraft flight instrumentation, and more particularly to a hybrid cathode ray tube display using digitally generated rasters and stroke vectors which superimposes stroke or raster symbols over the vector display in accordance with a desired priority.

2. Description of the Prior Art

In the use of electronic display systems for aircraft instruments it has become increasingly important to devise methods for presenting the information to the flight crew in a clear, uncluttered manner. A conventional hybrid display system includes a stroke vector generator and a raster generator which supply alternately and sequentially a single CRT with a picture that includes both raster and stroke information. Stroke written CRT displays trace the shape of figures to be presented by deflecting the electron beam in a manner which connects a successive sequence of strokes or vectors, which may be straight or curved. In a raster system the beam is caused to trace a repetitive pattern of parallel scan lines and the information is presented by intensity modulating the electron beam at the appropriate points along each line.

As the size of cathode ray tube (CRT) displays increases, more symbology is placed on an individual indicator. Correspondingly, as the quantity and the complexity of the symbology increases, the risk of misinterpretation of data due to clutter and overlapping may increase. A key objective of the electronic CRT display technique is the assignment of priority of symbology to defined areas of the screen. A symbol of importance, when it intersects one of less importance, should appear to be on a plane closer to the viewer. The less important symbol should disappear behind it. It is also desired that this effect be attained even if both symbols are allowed to move. This minimizes any conflict of data presentation and is particularly effective, for example, as compared to the clutter and parallax of the flight director command cue presentation that is typical of conventional electromechanical attitude director indicators.

Prior art schemes for priority implementation generally employed a combination of stroke vectors for generating numerical data and index lines and raster generators for generating other symbology and background colors. One technique is a "cell" storage technique, which divides the display into a matrix of incremental display cell areas of the display screen. This approach is shown in U.S. Pat. No. 4,070,662, issued to Parm L. Narveson and assigned to the assignee of the present invention. A symbol memory provides for storing a plurality of patterns and symbols which can be selectively fetched to form a display picture. This technique is adequate for static priority areas, but is very cumbersome when the priority areas are changing. To produce a display pattern in which lower priority areas are masked, the display processor must first determine the pattern of on and off picture elements for each defined cell in the display. It must then generate the proper symbol representing the cell's pattern or choose from a predetermined library of symbols, and place that pattern at the proper cell location on the display. This imposes a considerable time-consuming load on the display processor, and is particularly difficult when moving symbology is necessary. Such software intensive techniques have a primary disadvantage of using large amounts of valuable computer time in a real-time system, where processing time is critical. Thus, although such symbology can be accomplished, it can be done only to a limited extent in practice in an aircraft instrumentation display and may require a significant amount of processor time to calculate the appropriate cell and symbol definitions.

A second approach is the full-field memory or bit-mapped technique, where each resolution element or picture element of the display is defined by a group of memory bits corresponding to the respective individual picture elements on the display screen. A picture is loaded into memory from a computer or other source of digital instructions and the entire memory is read out sequentially in synchronism with digital circuitry generating a raster. An image is produced by specifically setting, for each picture element, the color and priority desired by writing the appropriate data into the full-field memory. In readout, serial digital memory output works are converted to analog form and then transmitted to the CRT display for each frame refresh cycle. From a hardware standpoint, this approach is unattractive because of the size of the required support circuitry and processing time. Systems using a full-field memory typically provide loading of the memory with a processor. The number of storage elements in the full-field memory is the product of the vertical and horizontal resolution elements. For a display mask resolution of 256 lines by 512 pixels (picture elements) per line the number of memory bits required is 131,072. If color information is encoded, additional memory is required to specify a color. The time required for the processor to calculate the image pattern and to store so many elements in the full-field memory is considerable and may impose unacceptable restrictions on the display update rate and other required processor tasks.

The present invention utilizes the repetitive nature inherent in a conventional raster symbol generator scan to provide an apparatus for loading a stroke priority full-field memory without requiring access to extensive processor time and permits efficient generator of dynamic stroke priority areas. The circuits that are disclosed herein permit masking of the stroke vector symbology in accordance with the desired priority, and optional superposition of stroke vector and raster scan displays.

SUMMARY OF THE INVENTION

According to the invention there is provided an apparatus for superimposing symbols on an electronic display, responsive to a source of digital instructions. The apparatus comprises means for providing a stroke vector positional signal and means responsive to a priority signal and the digital instructions for generating signals to position stroke vectors. The display is energized by the stroke vector signals and responds preferentially to the priority signal, thereby masking a portion of the display within selected regions.

In a preferred embodiment, the apparatus includes a raster symbol generator for loading a bit-mapped full-field memory with the priority signal, which is coupled to control a stroke vector generator for energizing the display. The raster generator may optionally be used to superimpose raster and stroke vector signals in a hybrid display with the masked stroke vectors. The display is sequentially and alternately energized by the stroke vector positional signals and the raster symbol character signals, thereby providing a display comprised of a raster symbol character display superimposed on a stroke vector display, with the raster display disposed to preferentially mask stroke vector characters of lesser priority.

In a further preferred embodiment, the means for preferentially masking on the stroke vector display includes a clock pulse source for providing timing signals. A counter coupled to the clock pulse source provides a corresponding pixel count signal and raster X and Y axis count signals, corresponding to sequential raster lines and sequential picture elements along the raster lines. The count signals, timing signals, and stroke vector positional signals from a stroke vector generator are coupled to a multiplexer-type switch which addresses a stroke priority full-field bit-mapped memory. A logic switch coupled to the clock pulse source provides control signals for reading and writing in the full-field memory. Priority data from a raster symbol generator is thereby entered into the full-field memory and read out in synchronism with the stroke vector positional signals to provide priority masking data to the stroke vector generator. The video output of the stroke vector generator is thereby masked by the prioritized symbology, and applied with the stroke vector positional data to control the position and color of the beam of a cathode ray tube.

DESCRIPTION OF THE PREFERRED EMBODIMENT

In general terms, the face of a display apparatus such as a CRT is sequentially and alternately excited by a raster symbol character generator and a stroke vector generator. Horizontal and vertical count signals increment at the raster line rate and the picture element rate, respectively, and when applied to the raster symbol character generator load corresponding priority command data into a stroke priority full-field memory. By means of the repetitive nature of the raster scan lines and the corresponding pixel counts, raster color symbology may be defined by points where selected pixels intersect with a stroke vector and the resultant outlines filled in with a desired color during the actual raster display time. This "filling in" procedure may also be used to produce and write stroke priority data into a full-field memory. The X and Y counts produced for the raster display, corresponding to beam deflections across Cartesian coordinates, may be used to address locations in the stroke priority full-field memory, and the serial video bit stream produced thereby can be stored as the priority data. For each raster picture element, the video bit is written into the location in the full-field memory addressed by the X and Y position counts. In this manner, the stroke priority full-field memory can be addressed with data corresponding to the priority areas on the screen without consuming large amounts of processor time. The use of edge defined, "filled-in" raster type devices, such as disclosed in copending application Ser. No. 06/595,810, Raster Display Generator For Hybrid Display System, invented by S. P. Grothe and assigned to the assignee of the present invention, is well adapted to use with this invention, but any conventional raster-type generator may also be used to fill a stroke priority full-field memory as previously described.

During the stroke display time, which follows a frame of the raster scan in sequence, the priority data stored in memory may optionally mask stroke symbology of lower priority as it intersects selected regions of greater importance. The stroke vector generator provides X and Y positional data and color video data during the stroke period of the refresh cycle. By masking the stroke vector signal at the point of intersection with a raster scan line, the stroke vector display may be blanked in selected areas, with the raster scan optionally superimposed thereon, thereby imposing minimal requirements for data storage and process time.

Figure 1:
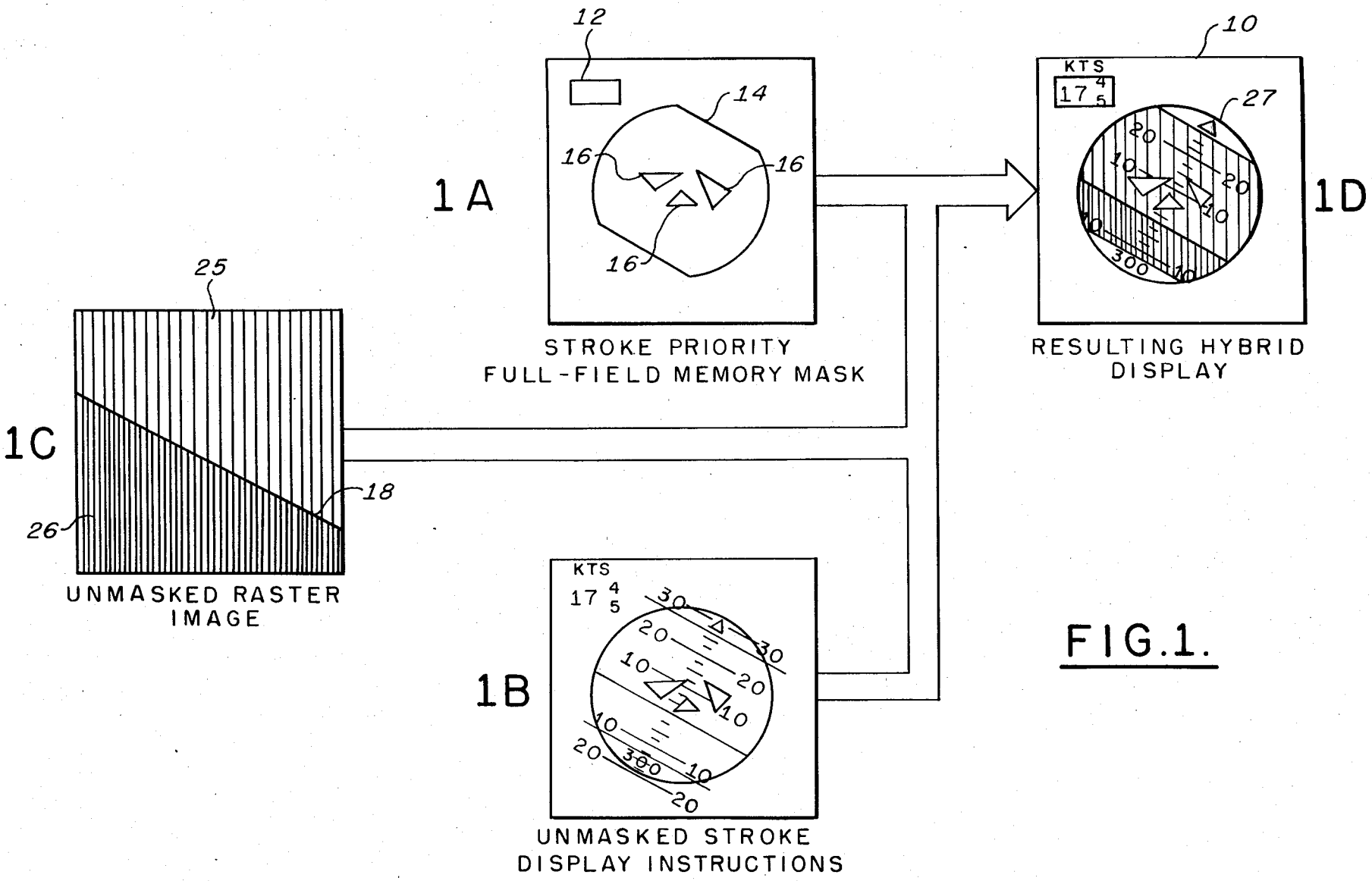
FIG. 1 is a pictorial representation of a stroke priority mask and raster image superimposed on an unmasked stroke vector image.

Referring to FIG. 1, which is a simplified example of masking stroke vector images to provide a stroke-masked display, a pictorial representation is shown of the face of a display apparatus generally denoted by reference numeral 10, which is comprised of a composite of stroke vector mask 1A, stroke vector image 1B and raster image 1C to form image 1D. It incudes a mask 1A, wherein zone 12 denotes an area designated for displaying digital characters, which in this example may be representative of airspeed in knots, and wherein zone 14 represents an indicator area containing a plurality of preferentially displayed triangular reference symbols 16. Image 1B shows a pictorial representation of an unmasked stroke vector image which it is desired to present on display face 10 with selected regions masked by instructions stored in mask 1A. Unmasked horizon line 18, digits 10, 20, etc., and index lines 10—10, 20—20, and 30—30 are formed by a stroke vector generator in a conventional manner to define image 1B. Sky and earth color zones 25 and 26, respectively, may also be provided as in image 1C by using a conventional raster symbol generator. Image 1D shows the resulting hybrid display. Alphanumeric symbology is displayed in stroke vector format, while priority information is provided by the full-field memory mask. Desirably, a portion of selected regions may be preferentially displayed or masked to remove clutter and assure presentation of essential monitoring functions, such as index 27. Thus, a full faced integrated flight instrument display format with prioritized symbology, as shown in FIG. 2, is provided to enhance the display of critical instrument functions.

Figure 2:
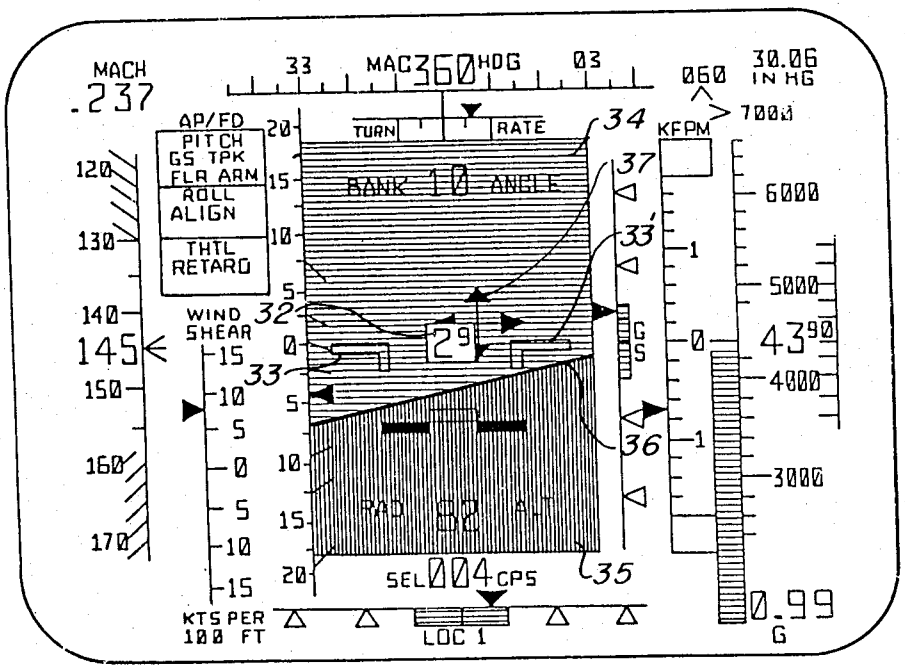
FIG. 2 is a pictorial representation of an integrated flight instrument display face using stroke vector and raster scan symbology.

FIG. 2, which represents a fully integrated hybrid display, shows a rectangular area 32 which represents the aircraft nose or fuselage and a pair of laterally extending bars 33, 33' representing its wings. The rectangular symbol 32 includes a numeric stroke vector readout representing the flight path angle of the aircraft. Sky shading 34 and ground shading 35 are provided by raster generation and are separated by a stroke vector representing horizon on line 36. The area of the nose symbol 32 is preferentially masked to provide priority over the sky-ground shading 34, 35 and a stroke vector flight director symbol 37. The position of the flight director cue 37 relative to the aircraft nose symbol 32 indicates the direction of corrective action required to satisfy the control commands. When the commands are satisfied, the crossed lines 37 will be masked by nose symbol 32. It is thus appreciated that the masking of the flight director symbol by the higher priority nose symbol results in a clear and uncluttered presentation of control commands or adjustments. A fuller disclosure of the applications of such a flight instrument display in a raster scan system is provided by H. Miller in U.S. Pat. No. 4,247,843, assigned to the assignee of the present invention.

This display face 10 may be, for example, the face of a conventional CRT, but it is appreciated that the invention is applicable to other types of displays as well, such as gas plasma displays, liquid crystal displays, or other electrically actuated displays.

Figure 3:
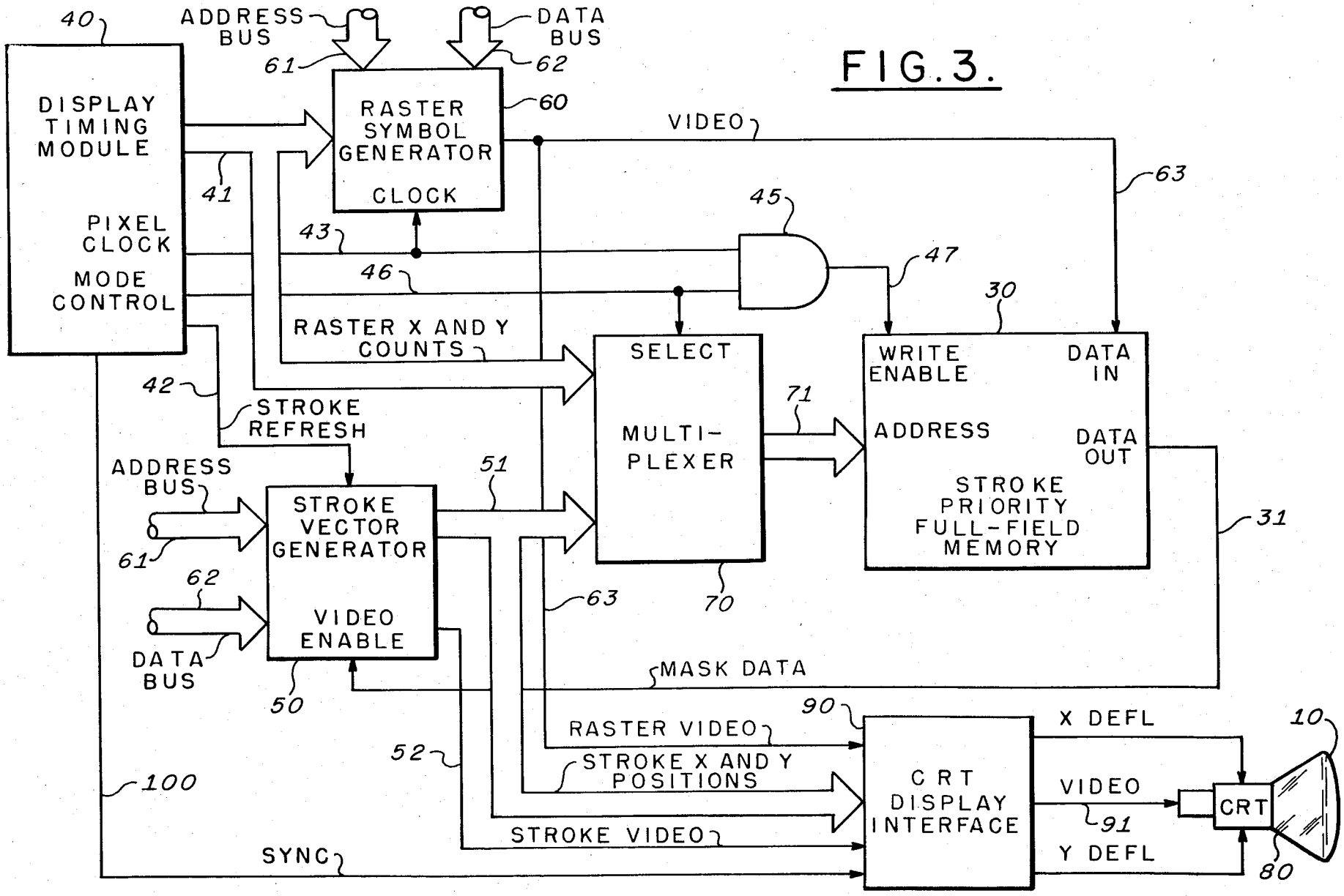
FIG. 3 is a schematic block diagram of a preferred embodiment of the invention.

Referring now to FIG. 3, there is shown in block diagram form a schematic drawing of a stroke priority full-field memory system including a raster scan. A bit-mapped full-field memory 30 is organized to have the same number of resolution elements as the raster scan. In a system having 256 raster lines with 512 picture elements along each line, a random access memory will require 131,072 bits. This assumes that there is a two-state control of each bit; that is, that the bit may be turned on or off in response to a command. Memory 30 includes in a conventional manner means for selectively addressing particular bits within the memory, writing video information into such bits, and reading out the stored data at a commanded address and time sequence. A display timing module 40 includes a clock pulse source for providing a plurality of timing signals. Thus, module 40 outputs an X count signal on bus 41, representing the sequence of raster lines being generated along the X (horizontal) axis and a raster Y count, also on bus 41, representing the sequence of pixels corresponding to a raster scan line along the Y (vertical) axis. The timing module 40 also produces a command signal on line 42 to a stroke vector generator 50 to initiate the generation of the vector display refresh cycle. A pixel clock signal on line 43 provides a timing signal corresponding to the sequential pixel rate to raster symbol generator 60 and AND gate 45. A mode control signal derived from the clock pulse source is provided on line 46 to AND gate 45 and to multiplexer 70 to initiate appropriate storage and readout functions during the respective stroke vector and raster scan portions of the refresh cycle. Further, the timing module 40 also provides horizontal and vertical synchronization pulses on line 100 in a conventional manner for energizing X and Y sweeps in interface 90 for the raster scan on a CRT 80.

The timing module 40 is provided with a clock oscillator (not shown) for generating regular clock pulses. In the preferred embodiment, this clock may preferably operate at 13.1 MHz. However, other clock rates suitable for the required display updating and associated circuitry are also suitable. The frequency of the clock oscillator is determined by the required resolution of the X and Y counts, a higher frequency being required for higher resolution systems. The clock pulses are sent to the pixel clock output and to a controller (not shown), which may be a programmable read only memory and latch to provide mode control and stroke vector initiate timing functions. The raster X count, raster Y count, and pixel clock are generated in synchronism with the pixel sweep to provide synchronized digital timing signals. In a manner to be shown, during a stroke display refresh interval the X and Y counts produced by the timing module will be used to address locations in the stroke priority full-field memory, and the serial video bit stream produced on readout by the raster symbol generator in response to instructions from a computer appropriately programmed on readout will be used as the input video masking data to the stroke vector generator. For each raster picture element, a video bit is written into a location in the full field memory corresponding to the X and Y position counts. In this manner, the stroke priority full-field memory can be loaded with data corresponding to priority areas on the screen without consuming substantial amounts of processor time.

During the stroke display refresh interval used to load full-field memory 30 with priority video data. A conventional computer interface (not shown) applies digital instruction signals to address bus 61 and data bus 62 in accordance with the masking display presentation to be generated on the display face 10 of CRT 80. Video data output in digital form from the generator 60 is provided on bus 63 to memory 30 and CRT 80. While for simplicity a common bus 63 is shown herein, in practice, as will be illustrated below, where a multiplicity of raster symbol generators may be used, the raster video provided to interface 90 on bus 63' may be a composite of the individual raster symbol generators, and the information provided to memory 30 on bus 63 will be a subset thereof defining the priority content.

Continuing during the raster display refresh interval, the mode control signal on line 46 when applied to multiplexer 70 will first select the inputs on bus 41, providing raster X and Y count signals. The output thereof is coupled on bus 71 to the address section of memory block 30. AND gate 45 is gated by the mode control signal on line 46 and the pixel clock signal on line 43 to permit writing data into memory 30 at each pixel clock interval. Thus, for each address in memory 30 corresponding to a predetermined raster X line count and raster Y pixel count, video priority data on line 63 is written into the full-field memory 30.

The pixel clock is initialized at the beginning of each raster scan and counts in synchronism with the pixels being generated to provide the raster Y count signal. The raster line counter, triggered by the pixel count, counts in synchronism with the raster lines being generated to provide the timing signal for the raster X count. Thus, raster symbol generator 60 is energized by the raster X and Y counts taken together to generate a video output corresponding to the pixel address currently being provided to the generator by the raster X and Y counts from timing module 40. As the raster scan proceeds, the raster X and raster Y counts increment accordingly and provide addressing to all the locations in memory 30. At each location addressed by the raster X and Y counts, the data represented by the raster video signal on line 63 is written into full-field memory 30. At the completion of the raster display refresh interval, memory 30 will have been updated with a complete pattern corresponding to the image loaded in the raster symbol generator 60.

The display timing module 40 may be organized to provide either sequential raster scan or interlaced fields.

In the case of an interlaced raster, one half of the memory 30 will be filled during each of the two raster fields. Typically, the field would be organized to command video modulation at a rate of 80 fields per second where a field is comprised of 128 raster lines with a resolution of 512 pixels per line. A rate of 80 fields per second is preferred in order to obtain a flicker-free presentation on the CRT face. Preferably, interlaced raster fields of 128 lines alternate every 12.5 milliseconds with a stroke vector field to form a complete display format on the face of the CRT at a frame rate of 40 Hz. The odd-even fields are generated conventionally.

Figure 4:
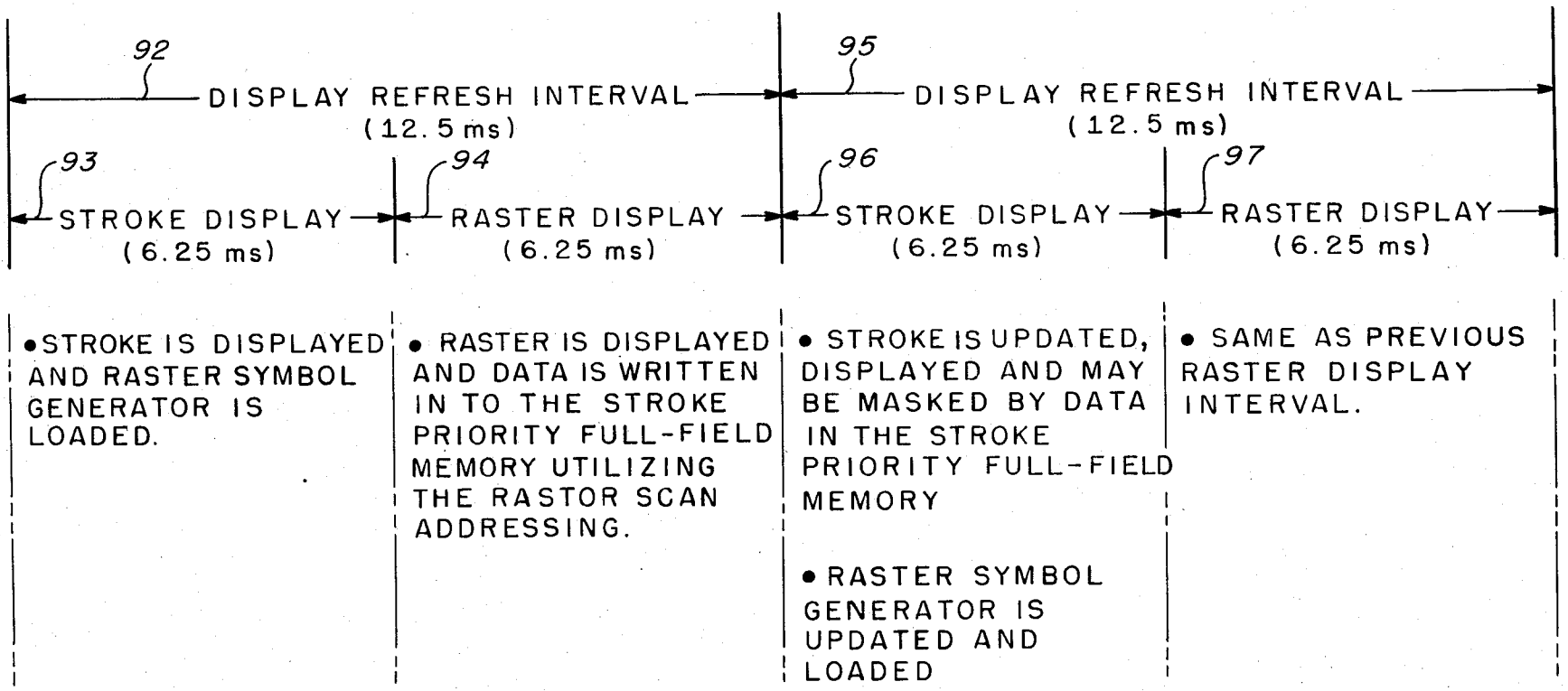
FIG. 4 shows a timing sequence diagram for a stroke priority display.

FIG. 4 shows a timing diagram of the stroke vector and raster refresh cycles of a hybrid display. A display refresh interval 92 is comprised of a 6.25 ms stroke display interval 93 followed by a 6.25 ms raster display interval 94. During the stroke display interval 93 the raster symbol generator is loaded from address bus 61 and data bus 62. All stroke masking data is written into the full-field memory during the raster display interval 92.

Referring again to FIG. 3, with continued reference to FIG. 4, during the display refresh interval 92 a stroke vector generator 50 is also loaded with instructions on address bus 61 and data bus 62 from an external computer, not shown. While the busses are shown here for simplicity in common with raster symbol generator 60, they may if desired be comprised of separate and distinct busses. The computer interface provides for generation of a stroke vector display presentation on the face 10 of CRT 80 in accordance with the instructions provided therefrom. These instructions are stored sequentially and completely define the stroke vector presentation. A vector generator (not shown) within stroke vector generator 50 provides the necessary X and Y deflection position signals 51 to CRT interface 90, as well as stroke video information which may provide color and intensity modulation on line 52. Stroke vector generator 50 may be comprised of a multiplexer for loading a stroke instruction memory, a vector generator for providing the X and Y deflection and stroke video signals, and the necessary control logic in a conventional manner. If desired, stroke vector generator 50 may be integrated with a raster symbol generator of the type shown in block 60 to permit filling in color raster information with minimal demands on processor and memory, as set forth in said Ser. No. 06/595,810.

During a successive display refresh interval 95 the stroke signal information is updated during display interval 96. The stroke priority full-field memory 30 is used to provide a mask for stroke symbology of lesser priority. During the stroke display portion 96 of the refresh interval, the raster symbol generator 60 is updated with current information on address bus 61 and data bus 62. During the subsequent raster display interval 97 the updated raster will be displayed while updated masking data is written into the stroke priority full-field memory 30 using the raster scan addressing scheme outlined above. During a stroke display interval, the mode control signal on line 46 is switched to a state such that multiplexer 70 accepts the input from stroke vector generator 50 on bus 51, which provides digital representations of the commanded CRT beam positions on the display screen. The stroke X and Y position values on bus 51 are transferred to bus 71 where they are allowed to address corresponding bits of memory in full-field memory 30. At the same time, the change of state of the mode control signal on line 46 disables AND gate 45. This inhibits the transfer of the pixel clock signl on line 43, thereby disabling the write signal on line 47 and transferring memory 30 to the read state. As the CRT beam is deflected across the display screen 10, the address X, Y to memory 30 changes accordingly. In the read state, for each address, a bit will be fetched from memory 30 which identifies by its state (i.e., 0 or 1) the existence or non-existence of a priority bit. This bit is provided at the mask data output line 31 and drives stroke vector generator 50 with a video enable signal. The mask data on line 31 may be used to blank stroke video output on line 52 in regions where a stroke has been defined as a low priority area. In this case, the stroke area will be overwritten by any superimposed raster symbology or higher priority stroke images. When it is desired to overwrite any underlying symbols, in accordance with instructions programmed into stroke vector generator 50 the stroke signal on line 52 will be permitted to address CRT interface 90. Stroke video on line 52 and raster video on line 63 may thereupon be combined by multiplexing in the CRT interface 90 in a conventional manner to provide a superposed video command signal 91 to CRT 80.

Following completion of the stroke vector display and loading of the raster symbol generator 60 with update information, the raster is again displayed. Thus, stroke and raster information are alternately and sequentially updated to provide a hybrid display on the face 10 of CRT 80.

CRT interface 90 is conventional, and provides for raster scanning, synchronized by a control signal 100 from timing module 40, multiplexing or other combination of the raster video and stroke video signals on lines 63 and 52, respectively, and conversion of the video signals and stroke X and Y positional signals from digital to analog form for driving CRT 80 in the conventional manner. The apparatus includes a conventional CRT 80 having a display face 10 energized by an electron beam whose position is controlled by X deflection and Y deflection signals applied to corresponding electrodes. A video signal applied to suitable control electrodes determines the color and intensity of the displayed output. Interface 90 provides X and Y sweeps for the raster of the cathode ray tube, generated by conventional sweep generators. The sweep generators may be comprised of the usual sawtooth waveform X and Y sweep generators for providing a conventional linear raster. Such sweep circuits are well known in television and display systems employing a raster scan.

The digital memories used in the preferred embodiment can be commercially available RAM integrated circuit chips such as used in small or microdigital data processors for storage. The various control functions including storing, fetching, and applying digital values as described above can be implemented conveniently by processor or other control logic included in or associated with the CRT display. Such control facilities are well known in digital displays for effecting various operations in synchronism with the display raster, e.g. character generation, cursor location, and stroke vector generation.

The digital-to-analog convertors and multiplexers may be of any suitable kind which combine binary voltages or currents to produce resultant outputs according to the inputs shown. Sweep amplifiers may be conventional analog amplifiers, such as may be formed by hybrid and integrated circuit techniques.

In operation the apparatus of FIG. 3 may be applied for providing moving displays with priority status that are utilized, for example, in aircraft. On initiation of the stroke display interval by timing module 40, the stroke vector generator 50 is commanded to execute a sequence of stroke instructions which have been stored in stroke instruction memory integral therein by means of computer address bus 61 and computer data bus 62. The instructions result in the production of digital outputs on bus 51 representing the digital X position and Y position and digital values of video output on line 52 for each commanded position of the electron beam of the cathode ray tube 80. The digital X position and digital Y position values on bus 51 are converted to corresponding analog X and Y deflection voltages and the digital stroke video signal 52 is converted to an analog video driving voltage by CRT interface 90 to drive CRT 80.

During the following raster display interval, timing module 40 generates a raster X count sequence to identify sequential raster scan line numbers and a raster Y count sequence to identify the sequential pixel numbers corresponding to the selected raster line on bus 41. These two counts are then entered into the raster symbol generator 60. The raster X and Y counts on bus 41 are also directed to multiplexer 70 to provide the respective addresses on bus 71 to stroke priority full-field memory 30. During the stroke display interval the computer information on address bus 61 and data bus 62 is further provided to load raster symbol generator 60, which outputs video priority data for entry into the random access memory 30 during the subsequent raster display interval.

At each increment of change in position of X and Y or change in color or intensity of video during the stroke refresh, the vector generator output on bus 51 and line 52 is updated. Simultaneously, computer input data is updated and loaded into raster symbol generator 60. Thus, during the stroke display interval, at the same time that the stroke information is displayed the raster symbol generator is loaded with the complete picture priority information for presentation of the raster display. On completion of the stroke vector portion of the refresh cycle, timing module 40 initiates the raster scan portion of the display. During the raster display interval the data previously loaded into generator 60 is written into stroke priority memory 30 utilizing the raster scan addressing scheme previously described. During the raster display interval AND gate 45 permits the entry of data from generator 60 into memory 30 at addresses corresponding to raster X and Y counts from timing module 40. This loads the full-field memory 30 with the priority data in which each bit in memory corresponds to a resolution element on the face 10 of the CRT 80. The stroke priority full-field memory 30 now contains a bit-map of the defined priority areas for the display. On completion of the raster display interval, a new stroke display refresh interval is initiated. Memory 30 is now addressed by stroke vector generator 50 through multplexer 70 to read out the previously loaded video priority data corresponding to each X and Y position. Thus, the display of the stroke vectors will be masked by the data output from memory 30. During this time period, raster symbol generator 60 will be loaded with updated information which is then written into memory 30 upon the subsequent raster display interval. The cycle thereupon repeats, updating on each subsequent display refresh interval. During the stroke display interval, stroke symbology which has less display priority is thereby masked by the contents of stroke priority full-field memory 30. This is done by reading a priority control bit out of the stroke full-field memory for each change in the stroke X and Y beam position command. For each position, the control bit either enables, if not in a priority area, or disables, if in a priority area, the stroke video of the masked symbology. The masked symbology is presented along with other stroke symbology to produce a resulting stroke display on the CRT and may be superimposed with a raster display.

It will be appreciated by one skilled in the art that by duplicating the raster symbol generator functions described above and processing the raster video outputs in parallel or sequentially to provide additional output channels additional color combinations or more complex symbology may be realized. The above process may be illustrated for the more general case of a plurality of raster generators by referring to FIG. 5. Raster 100 represents a raster image of the cell-mapped image type, as discussed in said U.S. Pat. No. 4,070,662. The face of the tube is divided into a plurality of cells 101 where a library of stored data may be called upon to present images in digital raster form such as block 102, circular area 103, and index 104. A second raster image is developed in raster 110 which may employ the edge-defined color display technique of said Ser. No. 06/595,810, although conventional raster symbol generators employing software or hardware programming are also suitable. Vectors 111 and 112 define the display boundaries and 116 and 117 the index elements. Raster 118 provides a further edge-defined image which may represent a moving horizon 119 in an attitude display.

Figure 5:
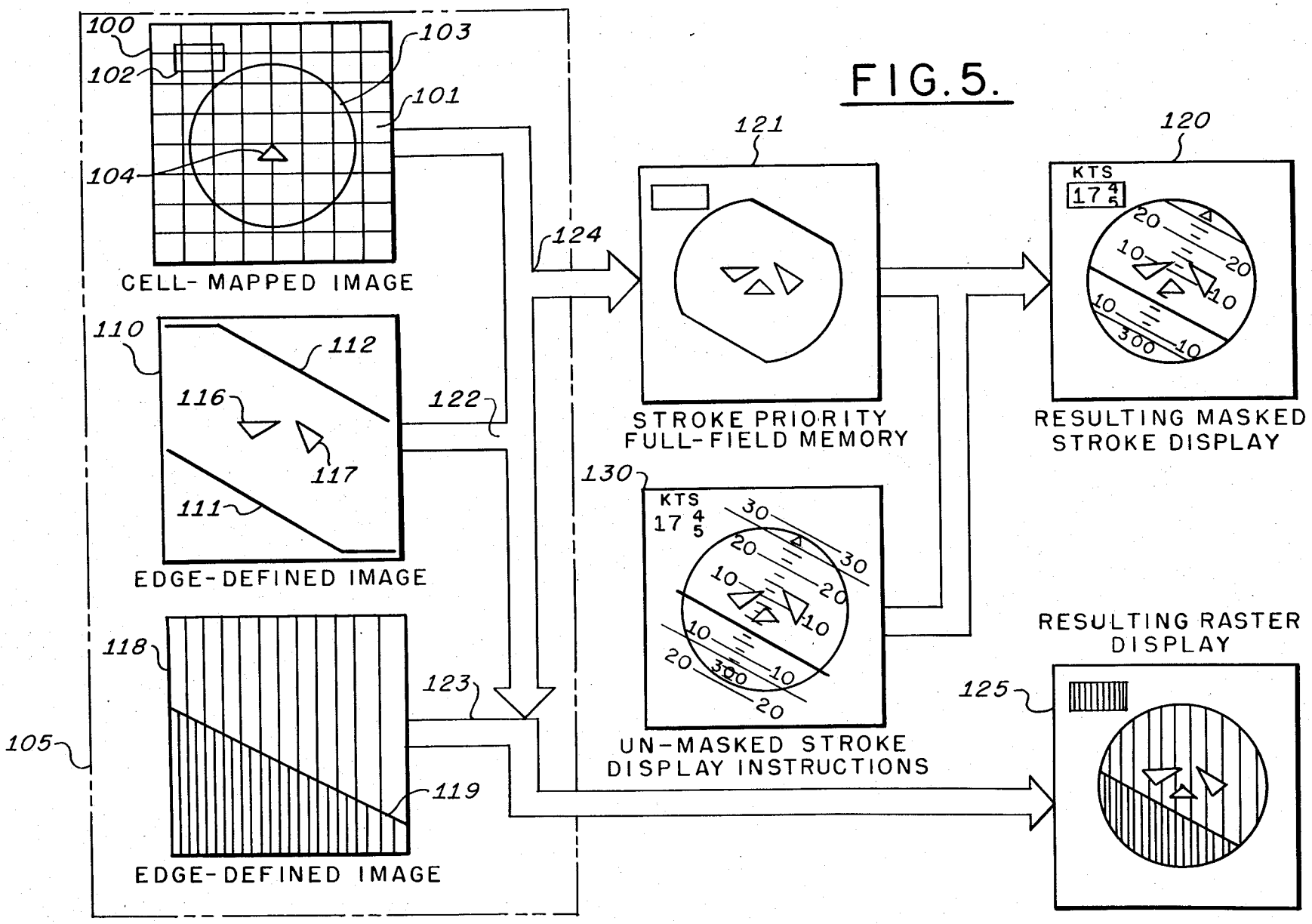
FIG. 5 shows pictorial representations of composite raster images and composite stroke vector images used to provide a priority-masked stroke vector display and a raster display.

FIGS. 3 and 5 illustrate the relationship of various display generator devices and buffers in the implementation to the resulting stroke and raster components of the image displayed on the face of the CRT. The order from left to right in the figure does not represent strict time sequence of events, but basic flow of data. Dashed line 105 denotes a raster symbol generator which is made up of various types of internal devices. The types of raster generator devices shown are the cell-mapped and edge-defined image generators. Although all the raster generators are conventionally designed for displaying raster symbology on the CRT, a particular device may be earmarked for useage only as a vehicle for generating data used for dynamic stroke priority, or it may serve a double purpose of producing displayed raster symbology as well as data for dynamic stroke priority. In the figure, cell-mapped raster generator 100 is utilized for both displayed raster symbology (as shown in image 120) and for supplying data to the stroke priority full-field memory 121. Raster generator 118 is used exclusively for the production of displayed raster symbology. The remaining device 110 is used in part for displayed raster symbology, and is used fully for the generation of data 121 for the stroke priority full-field memory 30.

In operation, during the raster display interval all raster symbol generator devices 100, 110, and 118 are read out simultaneously. The read-out is done in synchronism with the X and Y (line number and pixel number) counts associated with the raster scan. The outputs of the appropriate raster devices are combined in a parallel manner by a conventional logical operator indicated by the junctions 122–124. Logical operator 123 results in video (color) data which is used to produce the displayed raster symbology shown in image 125. Logical operator 124 results in the data which is written into RAM locations in the stroke priority full-field memory 30. At the conclusion of the raster display interval, the CRT face has been updated with image 125 and the stroke priority full-field memory 121 has been filled with one bit words representing a stroke priority image.

During the following stroke display interval, the stroke vector generator provides the incremental beam position X and Y commands and vectors which comprise the stroke display. Certain stroke vectors are programmed to respond to the contents of the stroke priority full-field memory 30. As they are displayed on the CRT face 10, these incremental vector beam movements are compared to the data at the corresonding locations (or positions) in the stroke priority full-field memory 30 and are either intensified or blanked on the CRT face, depending on the data word (0 or 1) stored in the stroke priority full-field memory. Image 120 shows the actual displayed stroke symbology as it appears on the face of the CRT 10. It is a combination of the unmasked stroke image 130 masked by the contents of the stroke priority full-field memory as denoted by block 121.

Since the displayed raster symbology and displayed stroke symbology appear on the face of the CRT sequentially and alternately at a high rate of refresh, the images are merged by the human eye to produce a single image which is an overly of the raster symbology on the stroke symbology.

While the invention has been described in its preferred embodiments it is to be understood that the words which have been used are words of description rather than limitation and that changes may be made within the purview of the appended claims without departing from the true scope and spirit of the invention in its broaded aspects.

We claim:

1. In a cathode ray tube hybrid display system of the type having a stroke vector display generator for supplying stroke vector information and a raster symbol generator for supplying raster scan information to the cathode ray tube, and means for preferentially masking at least a portion of the stroke vector display within selected regions, wherein the improvement comprises:

means for providing first and second coordinate positional data to said raster symbol generator, means for providing priority control data to said raster symbol generator during a stroke display interval, said data representative of a desired mask of stroke symbology, addressable memory means responsive to said coordinate positional data and said priority data for storing stroke priority command words corresponding to an orthogonal array of picture elements of said cathode ray tube in which each picture element has a unique binary address corresponding to increments of said raster scan along said first and second coordinates and for providing mask data signals to said stroke vector generator, means for providing stroke vector positional signals, means coupled to said raster symbol generator for writing said priority data corresponding to said stroke symbology mask in said memory during a raster display interval as said memory is addressed in regular increments of said coordinate positional data at a clock defined rate corresponding to incremental displacements of said picture elements, thereby storing a stroke priority field corresponding to said mask of stroke symbology, means coupled to said stroke generator for reading said priority data from said memory in synchronism with said clock rate during a stroke display interval and for modulating said stroke vector generator in accordance with said mask of stroke symbology, and mode control means for alternately applying said raster scan information and signals derived from said modulated stroke vector generator to said cathode ray tube to provide a superimposed masked stroke vector and raster scan display.

2. The system as set forth in claim 1, wherein said means for preferentially masking said stroke vector display comprises:

a clock pulse source for providing regular timing signals, digital counting means responsive to said pulse source for providing count signals representative of said first and second coordinates, switch means, responsive to said count signals and said stroke vector positional signals for selectively providing an output signal in accordance with said timing signals, for addressing said memory means, for writing said stroke command priority words in accordance with said count signals in said raster scan mode, and for reading said masked data signals to said stroke vector generator in said stroke vector mode, and logic means responsive to said timing signals and said mode control means for selectively transferring at least a portion of said timing signals.

3. The system as set forth in claim 2, wherein:

said clock pulse source further comprises (a) means for providing signals for synchronous energization of said stroke vector display and said raster scan display, (b) means for alternately providing raster information and masked stroke vector information to said cathode ray tube, and (c) means for reading said stroke priority data into said raster symbol generator while said stroke vector display is energized and for writing said stroke priority data into said memory means while said raster display is energized, said stroke vector generator comprises means responsive to said mask data signals, said stroke vector positional signals, and to said timing signals for providing signals representing a masked stroke vector of predetermined length, origin, and slope, said generator also providing said stroke vector positional signals to said switch means and said masked stroke video command signal to said electronic display, and said raster symbol generator comprises means responsive to at least one of said timing signals and to said count signals, for providing a signal to said memory means representative of a predetermined priority of said raster scan information with respect to said selected regions of said stroke vector display, and for providing a raster video command signal to said display system.

4. The system as set forth in claim 3, wherein said digital counting means comprises:

means for providing first sequential signals corresponding to a plurality of sequential picture elements along at least one of a plurality of raster lines comprising said raster display, and further comprising means for providing second sequential signals corresponding respectively to ones of said plurality of raster lines, at least a portion of said lines sequentially disposed on said electronic display, said first and second sequential signals having a predetermined ratio in frequency.

5. The system as set forth in claim 4, wherein said raster symbol generator comprises means for mapping a symbol memory having stored therein a plurality of patterns and symbols to be selectively written into incremental display area cells onto said electronic display, thereby to form a display picture.

6. The system as set forth in claim 4, wherein said display comprises cathode ray tube means having a display face, an electron beam, X and Y beam deflection means for positioning said beam along first and second axes, respectively, and color writing means.

7. The system as set forth in claim 6, further comprising display interface means for receiving said stroke vector positional signals, said signals for synchronous energization, and said video command signals from said stroke vector generator and said raster generator, for providing corresponding X and Y analog positional signals to said X and Y beam deflection means, respectively, and said stroke vector and raster video command signals to said color writing means.

8. The system as set forth in claim 7, in which said X axis is orthogonal to said Y axis.

9. The system as set forth in claim 8, in which said addressable memory means comprises a full-field bit-mapped representation of said display face.

10. The system as set forth in claim 9, wherein said raster symbol generator means provides interlaced scanning having at least two fields comprising a frame, wherein each of said fields is interposed between successive displays of said stroke vector.

11. The system as set forth in claim 10, wherein each of said fields is comprised of 128 sequential raster scan lines, each line comprised of 512 picture elements, and said field is refreshed at a rate of 80 Hz.

12. A hybrid display system for providing sequential displays of a raster scan and a stroke vector, comprising:

a cathode ray tube having a display face and first and second display axes, responsive to a source of beam positional signals and video color writing signals, means for providing a raster scan on said display face, said scan comprised of a plurality of raster lines along one of said display axes, at least one of said raster lines comprised of a plurality of sequential picture elements along one other than said one of said axes, raster symbol generator means coupled to receive signals from a source of digital data and, for providing a plurality of character symbols on said raster scan including priority data signals, said data signals corresponding to predetermined ones of said picture elements, stroke vector generating means responsive to said source of digital data and to said priority data signals, for providing a signal representing a stroke vector of predetermined length, origin and slope, and for providing said beam positional signals and at least a portion of said video color writing signals to said cathode ray tube thereby to provide a stroke vector display, clock means for providing first and second raster count timing signals corresponding to said raster scan lines and said sequential picture elements, respectively, said count signals in synchronous relationship therebetween, and for providing a mode select signal for selectively energizing said raster scan or said stroke vector display, addressable memory means responsive to said character symbols for storing instructions in digital form corresponding to priority designations of selected regions of said display face with respect to said stroke vector signals, said memory means providing a full-field bit-mapped representation of said display face, addressing means, coupled to said memory means and responsive to said mode select signal, said raster count timing signals and said stroke vector positional signals, for addressing said instructions in digital form, means for deriving a priority command signal from said memory means, means for providing said priority command signal to said stroke vector generator means to mask at least a portion of said stroke vector, synchronization means for loading said raster symbol generator and writing into said memory means during said raster scan and reading said memory means to derive a mask signal representative of said priority command signal during said stroke vector display, and sequentially and alternately displaying said raster scan and said stroke vector display with at least a portion of said stroke vector masked in said selected regions on said display face, and means for energizing said cathode ray tube by said synchronization means, whereby said raster scan and said masked stroke vector are alternately superimposed on said display face.

* * * * *